US005616880A

United States Patent [19]

Hayashida et al.

[11] Patent Number: 5,616,880

[45] Date of Patent: Apr. 1, 1997

[54] KEYBOARD MUSICAL INSTRUMENT EQUIPPED WITH HAMMER SHANK STOPPER WHERE HAMMER ASSEMBLY REBOUNDS WITHOUT DEFLECTION OF SHANK

[75] Inventors: Hajime Hayashida; Takashi Aoyagi; Satoshi Inoue; Ringi Nozue; Kiyoshi Kawamura; Shigeaki Sato, all of Shizuoka, Japan

[73] Assignee: Yamaha Corporation, Japan

[21] Appl. No.: 519,424

[22] Filed: Aug. 25, 1995

[30] Foreign Application Priority Data

Aug. 30, 1994 [JP] Japan ..... 6-205225
Apr. 10, 1995 [JP] Japan ..... 7-083724

[51] Int. Cl.[6] ..... G10D 15/00; G10F 1/22; G10H 1/34

[52] U.S. Cl. ..... 84/719; 84/720; 84/2; 84/3; 84/171

[58] Field of Search ..... 84/719, 720, 2, 84/3, 13, 18, 20–23, 171, DIG. 7, 423 R, 433

[56] References Cited

U.S. PATENT DOCUMENTS 2,250,065 7/1941 Koehl .
5,374,775 12/1994 Kawamura et al. ..... 84/615

FOREIGN PATENT DOCUMENTS 6-59667 3/1994 Japan .

*Primary Examiner*—Stanley J. Witkowski
*Attorney, Agent, or Firm*—Graham & James LLP

[57] ABSTRACT

An acoustic upright piano, an electronic sound system and a hammer stopper form in combination a keyboard musical instrument for generating acoustic sounds in an acoustic sound mode and electronic sounds in an electronic sound mode, and the hammer stopper has a rotatable shaft extending in a lower space under damper blocks of damper assemblies, cushion members projecting into an upper space over the damper blocks and connecting brackets provided between the rotatable shaft and the cushion members, thereby perfectly interrupting hammer motions before an impact on strings in the electronic sound mode.

14 Claims, 7 Drawing Sheets

KEYBOARD MUSICAL INSTRUMENT EQUIPPED WITH HAMMER SHANK STOPPER WHERE HAMMER ASSEMBLY REBOUNDS WITHOUT DEFLECTION OF SHANK

FIELD OF THE INVENTION

This invention relates to a keyboard musical instrument performable selectively through acoustic sounds and electronic sounds, more particularly, to a keyboard musical instrument equipped with a hammer shank stopper where a hammer assembly rebounds without deformation of the hammer shank for preventing strings from an impact.

DESCRIPTION OF THE RELATED ART

A typical example of the acoustic piano has a soft pedal linked with a hammer rail or a key frame, and the player makes the home positions of the hammer assemblies closer to the strings or offset from the strings by stepping on the soft pedal. When the hammer assemblies become closer to or offset from the strings, the hammer head softly strikes the associated set of strings or strikes the associated strings fewer than the normal number of the strings so as to lessen the loudness. Such a soft pedal is usually used for an artistic representation.

Piano tones are too loud for neighbors living an apartment house to be comfortable, and various silencers have been proposed. One of the silencers is disclosed in U.S. Pat. No. 2,250,065 and the silencer picks up the hammer assemblies so as to space them from the key action mechanisms. Even if a player fingers on the keyboard, the depressed keys merely moves the key action mechanisms only, and the hammer assemblies are not driven for rotation by the key action mechanisms. An electronic sound generator is incorporated in the piano disclosed in the U.S. Patent, and generates electronic sounds instead of the acoustic sounds. However, the key touch is quite different from that of the acoustic piano due to the separation of the hammer assemblies from the key action mechanisms, and the piano equipped with the silencer does not satisfy a senior pianist.

Another silent system is disclosed in Japanese Patent Publication of Unexamined Application No. 6-59667, and the prior art silent system is illustrated in FIG. 1 of the drawings. The Japanese Patent Publication of Unexamined Application publishes the invention disclosed in Japanese Patent Application No. 5-157934 which was filed under the domestic priority right of Japanese Patent Application No. 4-174813. Japanese Patent Application No. 4-174813 further provided the Convention Priority Right to U.S. Ser. No. 08/073,092, and the U.S. patent application resulted in U.S. Pat. No. 5,374,775 issued on Dec. 20, 1994.

The silent system includes a hammer stopper 1 provided in a narrow space between hammer assemblies 2 and damper assemblies 3. Though not shown in FIG. 1, a key of the keyboard is functionally connected to a key action mechanism, and the key action mechanism rotates the hammer assembly 2. The damper assembly 3 is respectively provided for a set of string 4, and leaves the associated strings during a hammer impact on the strings 4. When the hammer assembly 2 strikes the strings 4, the strings 4 vibrate for generating an acoustic tone. The function of tone generation is similar to that of an acoustic piano.

A rotatable shaft 1*a*, bracket members 1*b* and cushion members 1*c* form parts of the hammer stopper 1. The brackets 1*b* are attached to the rotatable shaft 1*b* at intervals in the longitudinal direction of the shaft 1*a*, and the cushion members 1*c* are respectively fixed to the cushion members 1*b*. The rotatable shaft 1*a* is rotatably supported by side board members, and a driving means such as a motor unit or a manipulative link mechanism bi-directionally rotates the shaft so as to change the cushion members 1*c* between a free position FP and a blocking position BP.

While the cushion members 1*c* are in the free position FP, the hammer assembly 2 can shrike the strings without an interruption of the hammer shopper 1, and the strings 4 generate the acoustic tone. On the other hand, if the cushion member 1*c* is changed into the blocking position, the hammer assembly 2 rebounds on the cushion member 1*c* before an impact on the strings 4, and a tone generator (not shown) generates an electronic sound through a headphone.

In the prior art keyboard musical instrument disclosed in the Japanese Patent Publication of Unexamined Application, a depressed key actuates the associated key action mechanism, and the jack of the key action mechanism escapes from the associated hammer assembly 2 in both performances through the acoustic tones and the electronic tones. When the jack escapes from the hammer assembly 2, the player feels the unique key touch, and the hammer assembly sharks the free rotation toward the strings 4. Thus, the prior art keyboard musical instrument gives the unique key touch to the player, and selectively generates the acoustic tones and the electronic tones.

However, the prior art keyboard musical instrument shown in FIG. 1 encounters a problem in installation of the hammer stopper 1. In detail, a regulating button (not shown) is incorporated in the prior art keyboard musical instrument, and the jack escapes from the hammer assembly upon contact with the regulating button. The distance between the hammer head 2*a* and the strings 4 at the escaping point is usually regulated to several millimeters, and the hammer stopper 1 in the blocking position BP is expected to interrupt the free rotation of the hammer assembly between the escaping point and the impact on the strings 4. The hammer stopper 1 is located below the hammer head 3*a*, and allows the hammer head 3*a* to retract into a space over the hammer stopper 1. This means that the boss portion of the hammer shank 2*b* rebounds on the cushion member 1*c*, and the deformation of the hammer shank 2*b* at the rebound is not ignoreable. If the hammer stopper 1 is too close to the strings 4, the deformed hammer shank 2*b* allows the hammer head 2*a* to touch the strings, and noisy sound is mixed with the electronic tone. On the other hand, if the hammer stopper is too far from the strings 4, the hammer assembly 2 may never strike the strings 4. However, there is a risk of capture of hammer shank 2*b* between the jack and the hammer stopper 1. Of course, the undesirable capture is avoidable by regulating the escape to an early point. However, such an unusual regulation destroys the unique key touch. The deformation of the hammer shank 2*b* exerts undesirable load on the hammer butt and the butt flange.

The problem may be eliminated from the hammer assemblies 2 by installing the hammer stopper 1 in a space over the damper head 3*a*, because the leading end portion of the hammer shank 2*b* rebounds on the cushion member 1*c*. When the leading end portion of the hammer shank 2*b* rebounds on the cushion member 1*c*, the hammer shank 2*b* is less deformed rather than the rebound of the boss portion because of the short distance between the rebounding point and the hammer head 2*a*. However, the installation over the damper head 3*a* is not feasible. In detail, the hammer heads 2 are different in not only the size. The hammer heads 2*a* for the low pitch tones are largest, and the hammer heads 2*a* become small from the low pitch tones through middle pitch tones to the high pitch tones. The position of the hammer head 2*a* and the positions of the damper heads 3*a* are not constant. For example, the hammer heads 2*a* for several middle pitch tones are higher than the others, and the associated damper heads 3*a* are also held in contact with the strings 4 at higher positions than the others. This is because of the fact that the strings 13 cross other strings 13 around these several middle pitch tones. Moreover, the damper block screw 3*b* rearwardly projects from the damper head 3*a*, and makes the available space intermittently narrow. As a result, the hammer heads 2*a* and the damper heads 3*a* complicate the space available for the hammer stopper 1, and the straight rotatable shaft 1*a* hardly extends across the complicated space.

SUMMARY OF THE INVENTION

It is therefore an important object of the present invention to provide a keyboard musical instrument a hammer stopper of which is free from the problems inherent in the prior art keyboard musical instrument.

To accomplish the object, the present invention proposes to position a rotatable shaft and a cushion member in a lower sub-space and an upper sub-space, respectively.

In accordance with the present invention, there is provided a keyboard musical instrument allowing a player to perform a music selectively through acoustic sounds and electronic sounds, comprising: an acoustic piano including a plurality of keys selectively fingered by a player during a performance, a plurality of string means vibrative for generating the acoustic sounds, a plurality of hammer assemblies respectively turning from home positions toward the plurality of string means for producing vibrations in the plurality of strings, a first space being formed between the plurality of string means and the plurality of hammer assemblies at the home positions, a plurality of key action mechanisms respectively transferring forces exerted on the plurality of keys to the plurality of hammer assemblies so as to cause the plurality of hammer assemblies to turn, and a plurality of damper assemblies provided in a part of the first space and temporarily spacing from the plurality of string means so as to allow the plurality of string means to vibrate when the plurality of keys are depressed, a second space being left in the first space; an electronic sound generating system determining depressed keys of the plurality of keys for generating the electronic sounds corresponding to the acoustic sounds; and a silent system including a hammer stopper having a rotatable shaft extending in a lower sub-space of the second space under a virtual plane over which damper blocks of the plurality of damper assemblies project, a cushion means supported by the rotatable shaft and moved in an upper sub-space of the second space over the virtual plane between a free position and a blocking position, the cushion means in the free position allowing the plurality of hammer assemblies to strike the plurality of string means, the cushion means in the blocking position causing the plurality of hammer assemblies to rebound thereon without a strike at the plurality of string means.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 2:
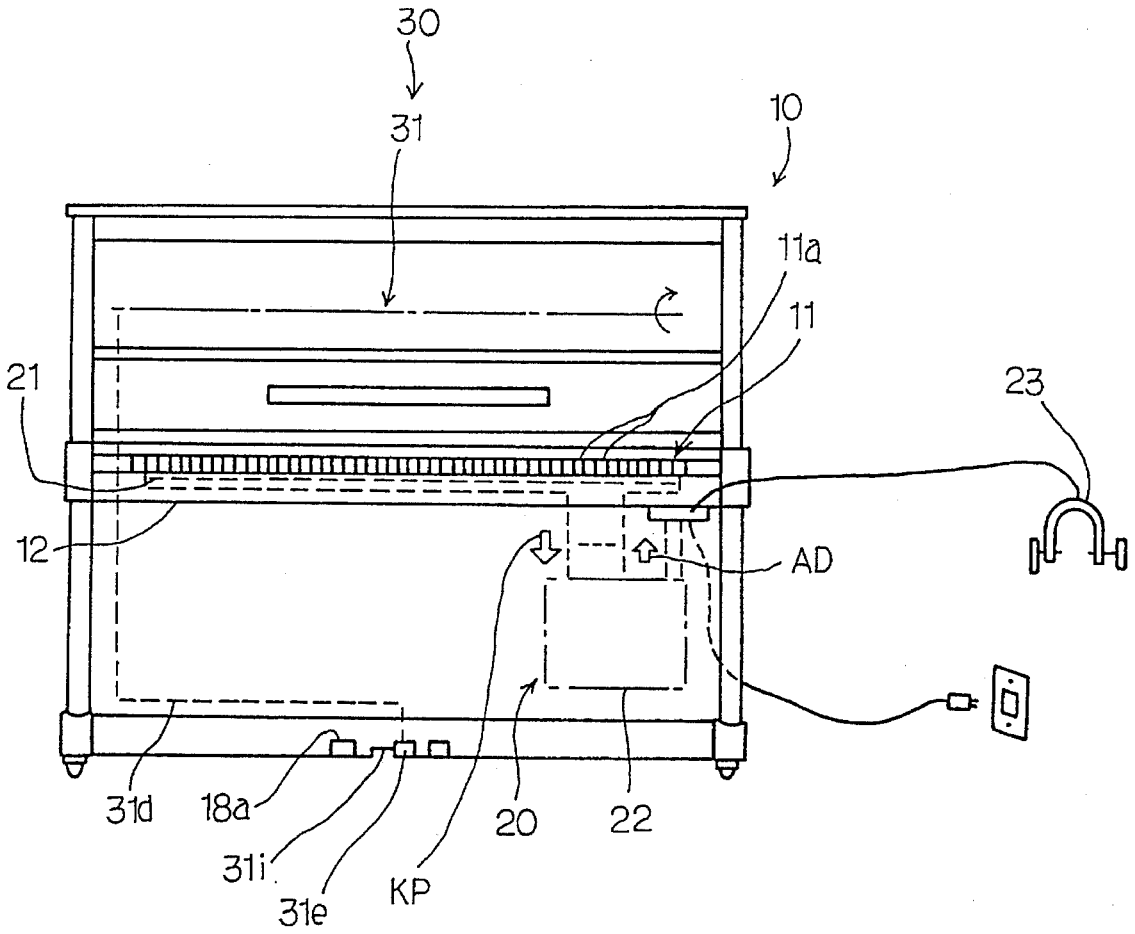
FIG. 2 is a front view showing the structure of a keyboard musical instrument according to the present invention.

Referring first to FIG. 2 of the drawings, a keyboard musical instrument embodying the present invention largely comprises an upright piano 10, an electronic sound generating system 20 and a silent system 30, and selectively enters into an acoustic sound mode and an electronic sound mode. While the keyboard musical instrument is staying in the acoustic sound mode, a player can perform a music through acoustic sounds. On the other hand, the player can perform the music through electronic sounds in the electronic sound mode. In the following description, word "front" means a position closer to a player than a position labeled with "rear", and directions "clockwise" and "counter clockwise" are determined on a sheet where a rotating part is illustrated.

The upright piano 10 includes a keyboard 11 provided over a key bed 12. Eighty-eight black and white keys 11*a* form in combination the keyboard 101, and are turnable around balance pins (not shown). The black and white keys 11*a* extend in a fore-and-aft direction of the upright piano, and front end portions of the black and white keys 11*a* are exposed to a player. While a force is not being exerted by the player, the black and white keys 11*a* are staying in respective rest positions. When the player depresses the black and white keys 11*a*, the black and white keys 11*a* are downwardly moved, and arrive at respective end positions. Notes of a scale are respectively assigned to the black and white keys 11*a*, respectively.

Figure 3:
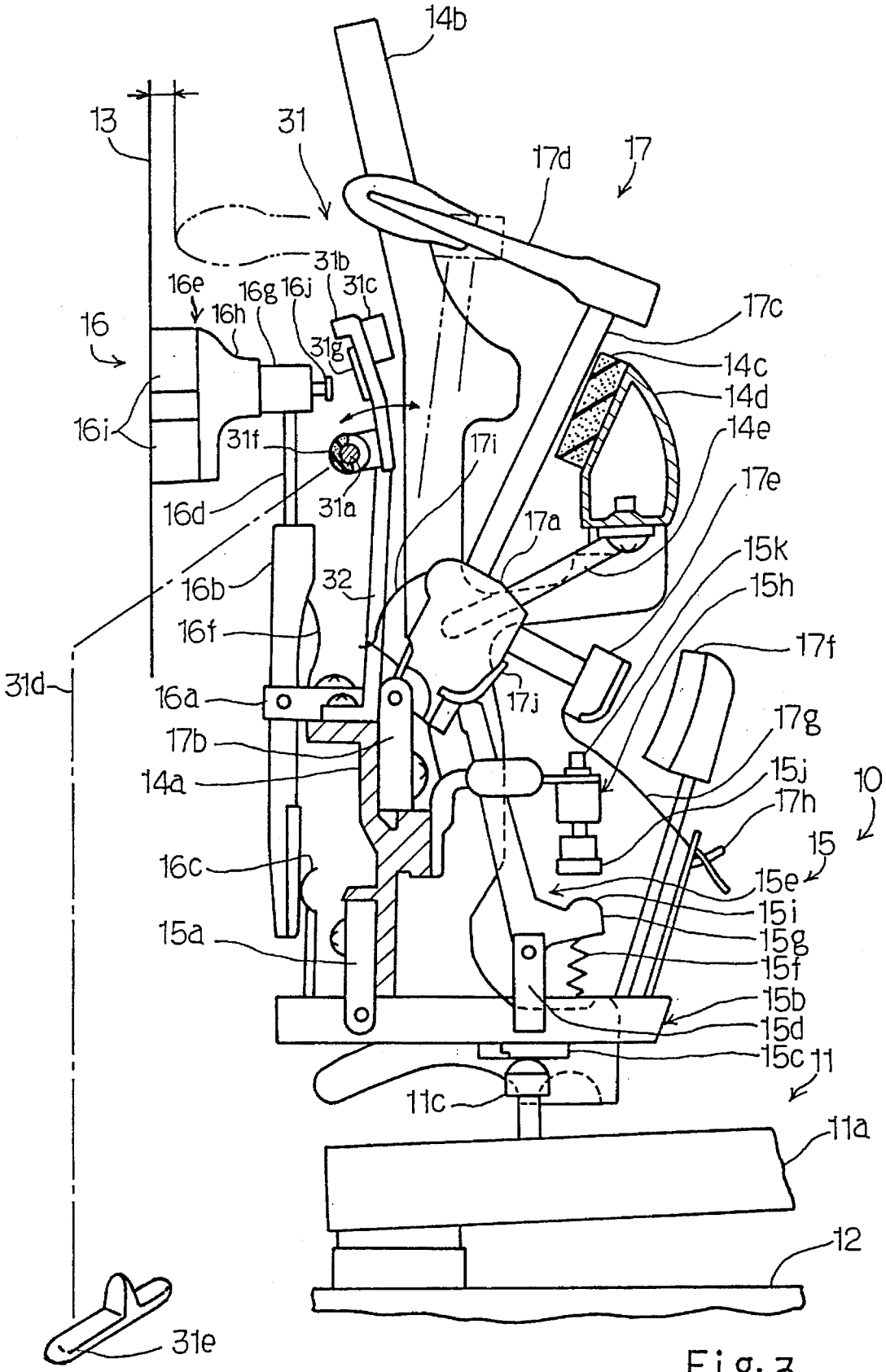
FIG. 3 is a side view showing relation among key action mechanisms, damper assemblies, hammer assemblies, strings and a hammer stopper.

The upright piano 10 further includes a plurality of sets of strings 13 as shown in FIG. 3. The plurality of sets of strings 13 extend in front of a frame (not shown), and are stretched between tuning pins (not shown) and hitch pins (not shown).

A center rail 14*a* laterally extends over the rear end portions of the black and white keys 11*a*, and is bolted to action brackets 14*b* at both ends and an intermediate point thereof.

The upright piano 10 further includes a plurality of key action mechanisms 15 functionally connected to the black and white keys 11*a*, a plurality of damper mechanisms 16 actuated by the key action mechanisms 15 for momentarily leaving the associated sets of strings 13 and a plurality of hammer assemblies 17 driven for rotation by the key action mechanisms 15.

When the player depresses one of the black and white keys 11*a*, the depressed key 11*a* causes the damper mechanism 16 to leave the set of strings 13, and actuates the key action mechanism 15 so as to drive the hammer assembly 108 for a free rotation. The hammer assembly 17 strikes the set of strings 13 in the acoustic sound mode, and the vibrating strings 13 generate an acoustic sound.

When the player releases the key 11*a*, the key action mechanism 15 and the hammer assembly 17 return to the initial status or home positions thereof, and the damper mechanism 16 is brought into contact with the strings 13 again, thereby absorbing the vibrations of the strings 13.

The key action mechanisms 15 are similar in arrangement to one another, and each key action mechanism 15 includes a whippen flange 15*a* bolted to a lower end portion of the center rail 14*a* and a whippen assembly 15*b* turnably connected to the whippen flange 15*a*. The whippen assembly 15*b* has a heel 15*c* held in contact with a capstan screw 11*c* implanted into the rear end portion of the black or white key 11*a*.

The key action mechanism 15 further includes a jack flange 15*d* upright from a middle portion of the whippen assembly 15*b*, a jack 15*e* turnably supported by the jack flange 15*d*, a jack spring 15*f* inserted between the whippen assembly 15*b* and a toe 15*g* of the jack 15*e* and a regulating button mechanism 15*h* opposed to the toe 15*g*. The jack 15*e* has an L-shape, and a swell 15*i* is formed in the upper portion of the toe 15*g*. The jack spring 15*f* urges the jack 15*e* in the counter clockwise direction at all times.

While the black or white key 11*a* is staying in the rest position, the whippen assembly 15*b* is horizontally maintained as shown in FIG. 3, and the swell 15*i* of the toe 15*g* is spaced from the regulating button mechanism 15*h*.

The regulating button mechanism 15*h* has a regulating button 15*j*, and the gap between the swell portion 15*i* and the regulating button 15*j* is changed by turning a regulating screw 15*k*. If the gap between the swell portion 15*i* and the regulating button 15*j* is increased, the jack 15*e* escapes from the hammer assembly 17 later. On the other hand, if the gap is decreased, the jack 15*e* escapes earlier.

When the swell portion 15*i* of the toe 15*g* is brought into contact with the regulating button 15*j*, the reaction impedes the turning motion of the whippen assembly 15*b* and, accordingly, the downward motion of the depressed key 11*a*, and the player feels the key 11*a* heavier than before. Thus, the jack 15*e* and the regulating button mechanism 15*h* deeply concern a key-touch, and the position of the regulating button 15*j* defines the starting point of the escape of the jack 15*e*.

The damper mechanisms 16 are similar in arrangement to one another, and each damper mechanism 16 includes a damper lever flange 16*a* fixed to an upper surface of the center rail 14*a*, a damper lever 16*b* rotatably supported by the damper lever flange 16*a*, a damper spoon 16*c* implanted into the rear end portion of the whippen assembly 15*b*, a damper wire 16*d* projecting from the damper lever 16*b*, a damper head 16*e* fixed to the damper wire 16*d* and a damper spring 16*f* urging the damper lever 16*b* in the counter clockwise direction. A damper block 16*g*, a damper wood 16*h*, damper felts 16*i* and a damper block screw 16*j* as a whole constitute the damper head 16*e*, and the damper spring 16*f* presses the damper felts 16*i* against the set of strings 13. The damper wire 16*d* is inserted into a mid point of the damper block 16*g* in the fore-and-aft direction, and the damper block screw 16*j* fixes the damper wire 16*d* to the damper wood 16*h*. The damper screw 16*j* projects from the front surface of the damper block 16*g*. For this reason, a space below the lower surface of the damper block 16*g* is wider than a space over the lower surface of the damper block 16*g*.

While the black or white key 11*a* is staying in the rest position, the damper spoon 16*c* does not push the damper lever 16*b*, and the damper felts 16*e* is held in contact with the set of strings 13.

If the player depresses the black or white key 11*a* from the rest position to the end position, the capstan screw 11*c* pushes up the whippen assembly 15*b*, and the whippen assembly 15*b* turns in the counter clockwise direction, thereby causing the damper spoon 16*c* to rearwardly push the lower portion of the damper lever 16*b*. As a result, the damper lever 16*b* is rotated in the clockwise direction, and the damper felts 16*i* leaves the set of strings 13.

On the other hand, when the black or white key 11*a* is released, the whippen assembly 16*b* turns in the clockwise direction, and the damper spoon 16*c* removes the pressure from the damper lever 16*b*. As a result, the damper spring 16*f* urges the damper lever 16*b* in the counter clockwise direction, and the damper felts 16*i* are brought into contact with the set of strings 13 again.

The hammer assemblies 17 are also similar in arrangement to one another. Each of the hammer assemblies 17 includes a hammer butt 17*a* turnably supported by a butt flange 17*b* fixed to the center rail 14*a*, a hammer shank 17*c* upwardly projecting from the hammer butt 17*a*, a hammer head 17*d* fixed to the leading end of the hammer shank 17*c*, a catcher 17*e* projecting from the hammer butt 17*a*, a back check 17*f* implanted into the front end portion of the whippen assembly 15*b*, a bridle tape 17*g* extending between the catcher 17*e* and a bridle wire 17*h* implanted into the front end portion of the whippen assembly 15*b* and a butt spring 17*i* urging the hammer butt 17*a* in the clockwise direction.

While the black or white key 11*a* is staying in the rest position, the top surface of the jack 15*e* is held in contact with a butt skin 17*j* attached to a lower surface of the hammer butt 17*a*, and the hammer shank 17*c* is resting on a hammer rail cloth 14*c* attached to a hammer rail 14*d*. The hammer rail cloth 14*c* defines initial status or a home position of the hammer assembly 17. A space is formed between the strings 13 and the hammer assemblies 17 at the home positions, and the damper assemblies 16 are installed and moved in the space. For this reason, the space is partially occupied by the damper assemblies 16, and a secondary space is left in the space. The secondary space is imaginary divided into a lower sub-space below the lower surfaces of the damper assemblies 16 and an upper sub-space over the lower surfaces, and the lower sub-space and the upper sub-space are available for the silent system 30.

The hammer rail 14*d* is supported through hammer rail hinges 14*e* by the action brackets 14*b*, and the hammer rail hinges 14*e* are turnable around the action brackets 14*b*.

A soft pedal 18*a* (see FIG. 2) is connected to the hammer rail hinges 14*e*, and the angular position of the hammer rail 14*d* is changed by manipulating the soft pedal 18*a*.

On the other hand, while the depressed key 11*a* is rotating the whippen assembly 15*b* and the jack 15*e* around the whippen flange 15*a* in the counter clockwise direction, the jack 15*e* pushes up and rotates the hammer assembly 17 in the counter clockwise direction. When the swell portion 15*i* is brought into contact with the regulating button 15*j*, the jack 15*e* is rotated in the clockwise direction around the jack flange 15*d*, and escapes from the hammer butt 17*a*. The jack 15*e* kicks the hammer butt 17*a* at the escape, and the hammer assembly 17 starts a free rotation toward the set of strings 13. In this instance, the hammer assembly 17 starts the free rotation at 3 to 5 millimeters between the strings 13 and the hammer head 17*d*.

If the keyboard musical instrument is operating in the acoustic sound mode, the hammer head 17*d* strikes the strings 13, and the vibrating strings 13 generate the acoustic sound having the note assigned to the depressed key 11*a*.

As described hereinbefore, when the swell portion 15*i* is brought into contact with the regulating button 15*j*, the jack 15*e* starts the escape. The escape is completed upon the release from the hammer butt 17*a*. When the jack 15*e* starts the escape, friction between the hop surface of the jack 15*e* and the butt skin 17*j* and the elastic force of the jack spring 15*f* cause the player to feel the depressed key 11*a* heavy. When the jack 15*e* completes the escape or the hammer butt 108 starts the free rotation, the friction is removed, and the jack spring 15*f* is stretched again so as to recover the jack 15*e* into the initial status with respect to the whippen assembly 15*b*. As a result, the player feels the key 11*a* lighter, and the change of the load from the rest position to the end position is called as "key touch". The change of the load from the starting point of the escape to the completing point of the escape is called as "after touch", and strongly impresses the key touch on the player.

After the strike of the strings, the hammer assembly 17 turns in the clockwise direction. When the key 11*a* reaches the end position, the catcher 17*e* is brought into contact with the back check 17*f*. At this time, the motion of the key/key action mechanism is temporarily stopped. Thereafter, the player leaves the finger from the key, and all the components return to the initial positions. Even though the catcher 17*e* rebounds on the back check 17*f*, the bridle tape 17*g* links the whippen assembly 15*b* with the hammer assembly 17, and prevents the set of strings 13 from a double strike. Moreover, if the player repeats the key 11*a*, the bridle tape 17*g* accelerates the returning motion of the hammer assembly 17, and the jack spring 15*f* urges the jack 15*e* so as to come into contact with the butt skin 17*j* again.

The key action mechanisms 15, the damper mechanisms 16 and the hammer assemblies 17 are similar to those of a standard upright piano.

Turning back to FIG. 2 of the drawings, the electronic system 20 comprises a plurality of key sensors 21 respectively provided under the black and white keys 11*a* for producing key position signals KP indicative of actual key positions, a controlling unit 22 responsive to the key position signals KP for generating an audio signal AD and a headphone 23 for generating electronic sounds. The key sensors 21 and the controlling unit 22 are similar to those disclosed in U.S. Pat. No. 5,374,775, and no further description is incorporated hereinbelow for the sake of simplicity.

Referring to FIG. 3 of the drawings again, the silent system 30 includes a hammer stopper 31, and a rotatable shaft 31*a*, a connecting frame 31*b*, cushion members 31*c* for the hammer shanks 17*c*, a link mechanism 31*d*, a pedal 31*e* and cushion members 31*f* and 31*g* form in combination the hammer stopper 31.

The rotatable shaft 31*a* is supported by suitable bearing units (not shown) mounted on metal brackets 32 of, for example, steel, and the metal brackets are fixed to the upper surface of the center rail 14*a*. The metallic brackets 32 are aligned with the action brackets 14*b*, and do not interfere in the motions of the key action mechanisms 15. The rotatable shaft 31*a* laterally extends in parallel to the center rail 14*a* in the lower sub-space of the afore-mentioned secondary space.

Figure 4:
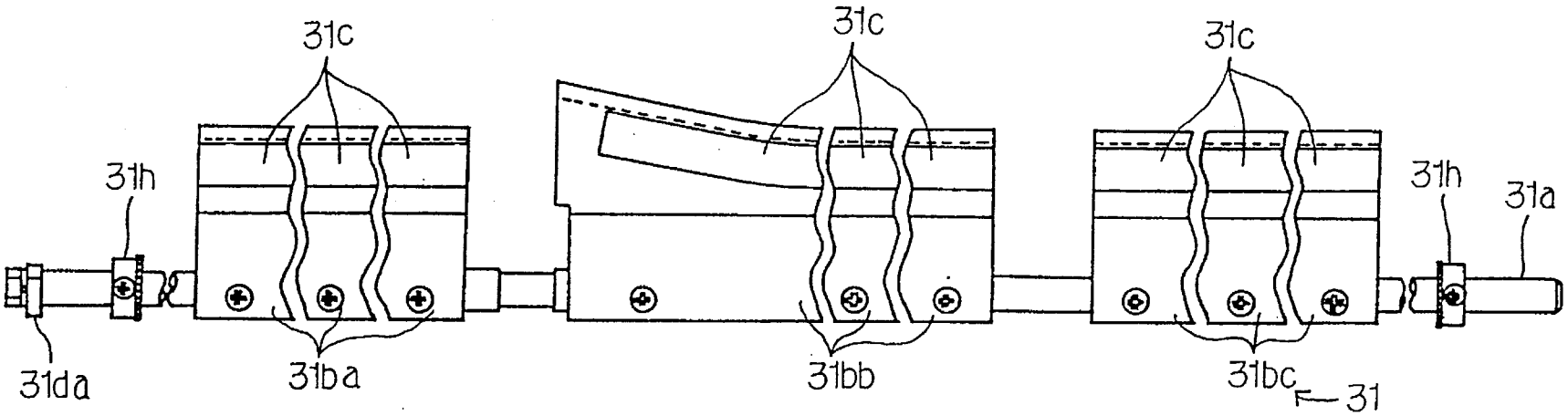
FIG. 4 is a front view showing a hammer stopper incorporated in the keyboard musical instrument.
Figure 5:
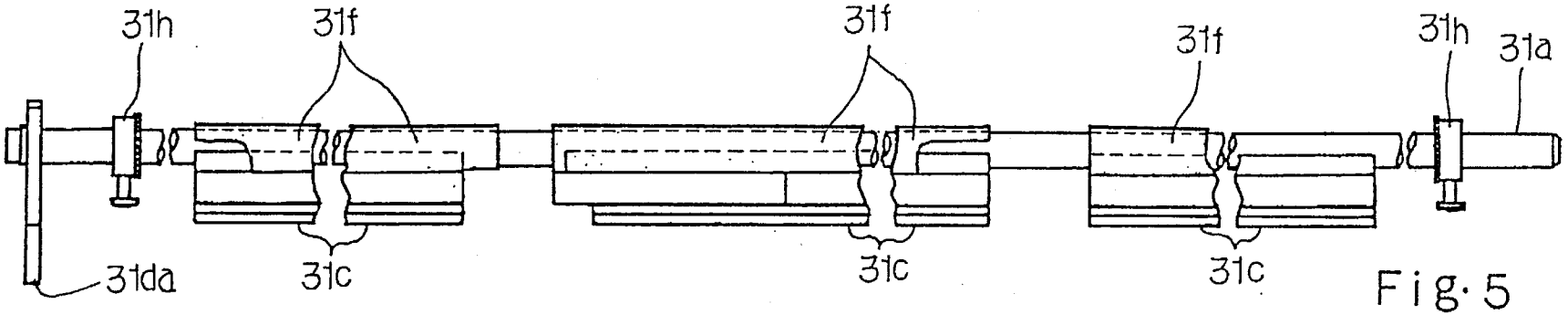
FIG. 5 is a bottom view showing the hammer stopper.

The connecting frame 31*b* is connected at the boss portion thereof to the rotatable shaft 31*a*, and projects into the upper sub-space of the secondary space. As shown in FIGS. 4 and 5, the connecting frame 31*b* is split into sections 31*ba*, 31*bb* and 31*bc*, and the action brackets 14*b* do not interfere in the angular motion of the hammer stopper 31. The hammer heads 17*d* for the several middle pitch tones are higher than the other hammer heads 17*d*, and the damper heads 16*e* are also higher than the others. For this reason, the middle section 31*bb* is upwardly curved, and allows the cushion member 31*c* to be opposed to the leading end portions of the hammer shanks 17*c*.

The cushion members 31*c* are attached to the front surface of the connecting frame 31*b*, and are opposed to leading end portions of the hammer shanks 17*c*. The cushion members 31*f* are directly attached to the rotatable shaft 31*a*, and are opposed to the damper wires 16*d*. The cushion members 31*g* are attached to the rear surface of the connecting frame 31*b*, and the damper block screws 16*j* are brought into contact with the cushion members 31*g*.

The height of the rotatable shaft 31*a* is equal to that of the prior art hammer stopper 1. However, the rotatable shaft 31*a* is adjusted in the fore-and-aft direction to a position where the damper wires 16*d* are brought into contact with the cushion members 31*f* upon arrival at maximum. Thus, the rotatable shaft 31*a* serves as a damper rail, and no damper rail is incorporated in the keyboard musical instrument.

The lower sub-space is wide enough to accommodate the rotatable shaft 31*a*, the cushion members 31*f* and the boss portion of the connecting frame 31*b*. Although the upper sub-space is narrower than the lower sub-space, it allows the leading end portion of the connecting frame 31*b* and the cushion members 31*c* to be changed between a free position and a blocking position. In order to decrease a moment exerted on the connection between the rotatable shaft 31*a* and the connecting frame 31*b*, it is desirable to make the rotatable shaft 31*a* as close to the lower surface of the damper blocks 16*j* as possible.

Figure 6:
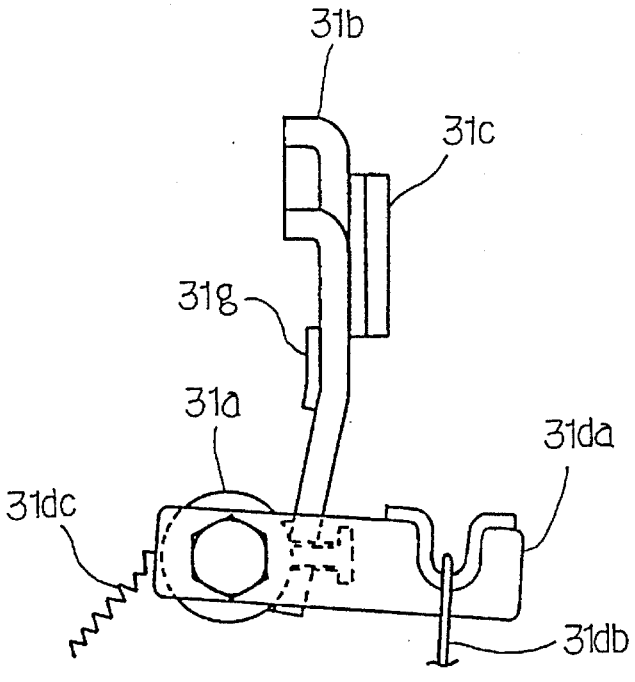
FIG. 6 is a side view showing the hammer stopper.

As shown in FIG. 6 of the drawings, the an arm member 31*da* is fixed to the rotatable shaft 31*a*, and a flexible wire 31*db* connects the arm member 31*da* to the pedal 31*e*. A return spring 31*dc* is further connected between the arm member 31*da* and a suitable stationary member, and urges the hammer stopper 31 in the counter clockwise direction. The arm member 31*da*, the flexible wire 31*db* and the return spring 31*dc* form parts of the link mechanism 31*d*. Stopper rings 31*h* are bolted to both end portions of the rotatable shaft 31*a*, and the stopper rings 31*h* maintain the alignment between the hammer stopper 31 and the hammer assemblies 17 in cooperation with counter members (not shown) fixed to the action brackets 14*b*.

If the player steps on the pedal 31*e*, the shaft 31*a* and, accordingly, the cushion members 3*c* turn in the clockwise direction, and the hammer stopper 31 is changed from a free position to a blocking position.

The connecting frame 31*b* is rigid, and the deflection due to the rebound of the hammer shanks 17*c* is ignoreable. The connecting frame 31*b* is rearwardly bent, and the cushion members 31*c* in the free position are maintained out of the trajectories of the hammer shanks 17*c* in the acoustic sound mode. While the hammer stopper 31 is staying in the free position, the hammer assemblies 17 strike the strings 13 without an interruption of the hammer stopper, and the strings 13 generate the acoustic sounds.

Figure 7:
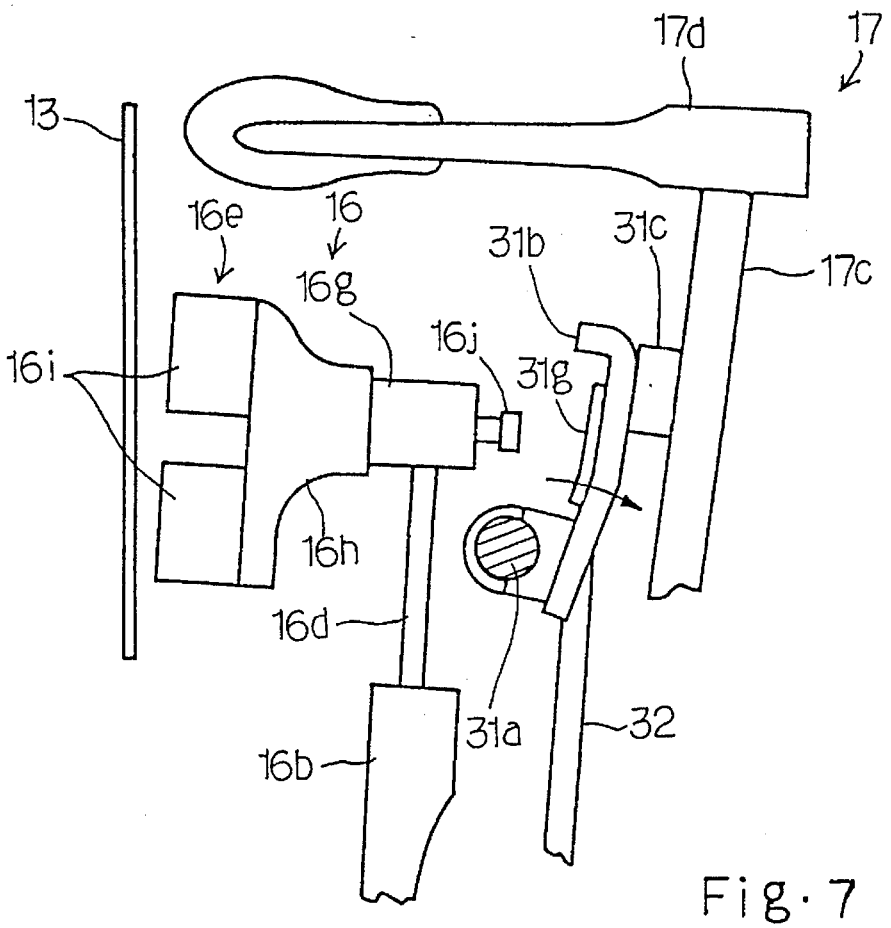
FIG. 7 is a side view showing the hammer stopper in the blocking position.
Figure 8:
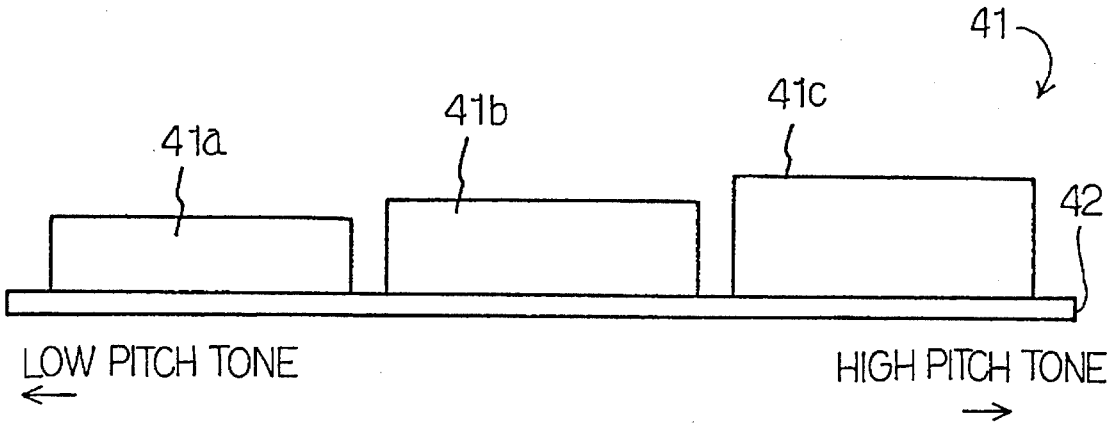
FIG. 8 is a plan view showing another connecting frame.

On the other hand, the cushion members 31*c* in the blocking position are in the trajectories of the hammer shanks 17*c*, and the hammer shanks 17*c* rebound on the cushion members 31*c* before the hammer heads 17*d* reach the strings 13. When the hammer shank 17*c* rebounds on the cushion member 31*c*, the front surface of the cushion member 31*c* is in parallel to the hammer shank 17*c* as shown in FIG. 7. This feature, i.e., the parallel contact between the hammer shank 17*c* and the cushion member 31*c* is desirable, because the hammer shank 17*c* exerts a force in the tangential direction only. The hammer stopper 31 does not undesirably shake, and is prevented from breakage. Thus, the cushion members 31*c* receive the hammer shanks 17*c* in parallel, and are equal in thickness over the width. The hammer assembly 17 and the damper assembly 16 shown in FIG. 7 are provided for the strings 13 for a high pitch tone.

If the player releases the pedal 31*e*, the return spring 31*dc* changes the hammer stopper 31 from the free the cushion members 31*c* enters into the blocking position.

Figure 1:
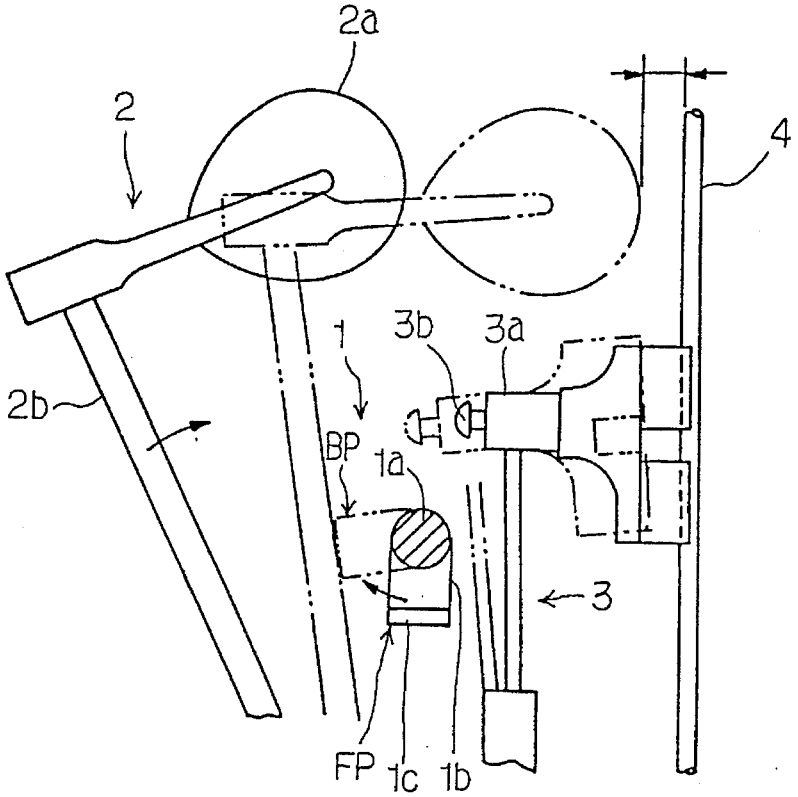
Fig. 1 PRIOR ART
FIG. 1 is a side view showing the hammer stopper incorporated in the prior art keyboard musical instrument.

In this instance, the hammer assembly 17 starts the free rotation at respective positions where the hammer heads 17*d* reach 3 to 5 millimeters from the strings 13, and the hammer stopper 31 can perfectly prevent the strings 13 from undesirable vibrations in the electronic sound mode. The prior art hammer stopper 1 shown in FIG. 1 requires 10 to 15 millimeters so as to perfectly prevent the strings 4 from undesirable vibrations due to the deflection.

In this instance, only the section 31*bb* is partially bent. However, another connecting frame 41 may have sections 41*a*, 41*b* and 41*c* which have respective front edges differently spaced from a rotatable shaft 42. As described hereinbefore, the hammer heads 17*d* are different in size, and a space between the hammer heads 17*d* and the damper heads 16*e* is increased from the low pitch tones through the middle pitch tones to the high pitch tones. In this situation, the sections 41*a*, 41*b* and 41*c* allow the manufacturer to change the positions of the cushion members, and all the hammer shanks 17*c* rebound on the cushion members at leading end portions as close to the hammer heads 17*d* as possible.

Description is hereinbelow made on the behaviors of the keyboard musical instrument in a performance on the keyboard.

First, a player is assumed to perform a music through the acoustic sounds. The player keeps the pedal 31*e* released, and the return spring 31*dc* urges the arm member 31*da* in the counter clockwise direction. As a result, the hammer stopper 31 remains in the free position, and the keyboard musical instrument is in the acoustic sound mode.

When the player depresses the key 11*a* in the performance, the capstan button 11*c* pushes up the whippen assembly 15*b*, and the whippen assembly 15*b* and the jack 15*e* are rotated around the whippen flange 15*a* in the counter clockwise direction. The jack 15*e* is not rotated around the jack flange 15*d* until the swell portion 15*i* is brought into contact with the regulating button 15*j*. The jack 106*e* pushes the hammer butt 17*a*, and forcibly rotates the hammer assembly 17 in the counter clockwise direction.

The depressed key 11*a* declines the damper soon 16*c*, and the damper spoon 16*c* pushes the lower portion of the damper lever 16*b* in the clockwise direction. The damper felts 16*i* leaves the strings 13, and allow the strings 13 to vibrate. When the damper wire 16*d* is brought into contact with the cushion member 31*f*, the damper assembly 16 stops the rotation in the clockwise direction, and is maintained on the cushion member 31*f*. If the damper block screw 16*j* widely projects from the damper block 16*g*, the damper block screw 16*j* may be brought into contact with the cushion member 31*g*. In this situation, the damper assembly 16 is maintained on the cushion member 31*g*.

When the swell portion 15*i* is brought into contact with the regulating button 15*j*, the rotation of the whippen assembly 15*b* causes the jack 15*e* to rotate in the clockwise direction around the jack flange 15*d* against the jack spring, and the jack 15*e* escapes from the hammer butt 17*a*. Thus, the jack 15*e* starts the escape at the contact with the regulating button 15*j*, and completes the escape from the hammer butt 17*a*. The player feels the key touch as similar to a standard acoustic upright piano.

After the jack 15*e* escapes from the hammer butt 17*a*, the hammer assembly 17 starts the free rotation toward the set of strings 13. The hammer stopper 31 in the free position does not interrupts the hammer action, and the hammer head 17*d* strikes the strings 13.

The hammer head 17*d* rebounds on the set of strings 13, and returns to the home position on the hammer. The set of strings 13 vibrates, and generates the acoustic sound.

On the other hand, if the player wants to perform a music without an acoustic sound, the player steps on the pedal 31*e*, and engages the pedal 31*e* with a step 31*i* (see FIG. 2). The pedal 31*e* pulls down the flexible wire 31*db*, and the flexible wire 31*db* rotates the arm member 31*da* in the clockwise direction. The hammer stopper 31 enters into the blocking position, and the cushion members 31*c* are positioned on the trajectories of the hammer shanks 17*c*. Thus, the keyboard musical instrument enters into the electronic sound mode.

Assuming now that the player depresses the key 11*a* in during the performance in the electronic sound mode, the capstan button 11*c* pushes up the whippen assembly 15*b*, and the whippen assembly 15*b* and the jack 15*e* are rotated around the whippen flange 15*a* in the counter clockwise direction.

The damper assembly 16 behaves as similar to that in the acoustic sound mode, and the behavior is not described for avoiding repetition.

The swell portion 15*i* is brought into contact with the regulating button 15*j*, and the rotating whippen assembly 15*b* causes the jack 15*e* to escape from the hammer butt 17*a* as similar to that in the acoustic sound mode. The cushion members 31*c* in the upper sub-space prevent the hammer shanks 17*c* from undesirable wide deflection, and the escaping point is regulated to that of the standard acoustic upright piano. For this reason, the hammer shank 17*c* is never caught between the jack 15*e* and the hammer stopper 31.

While the jack 15*e* is escaping form the hammer butt 17*a*, the key action mechanism 15 varies the load exerted on the finger, and the player feels the key touch as usual.

After the escape, the hammer heads 17*d* starts the free rotation toward the set of strings 13, and the hammer shank 17*c* rebounds on the cushion member 31*c* before a strike at the strings 13. The leading end portion of the shank 17*c* is brought into contact with the cushion member 31*c*, and the hammer shank 17*c* is merely deflected slightly. For this reason, although the escaping point is not changed, the hammer head 17*d* does not touch the strings 13, and the acoustic sound is never generated.

After the rebound on the cushion member 320*d*, the hammer assembly 108 returns to the home position.

As will be understood from the foregoing description, the cushion members 31*c* in the upper sub-space cause the hammer shanks 17*c* to rebound without wide deflection, and the jacks 15*e* escape from the associated hammer butts 17*a* at the same points as those of the standard acoustic upright piano. For this reason, the keyboard musical instrument according ho the present invention gives the same key touch to the player in both acoustic and electronic sound modes as the standard acoustic upright piano.

The difference between the hammer heads 2*a* and 17*d* due to the deflection of the hammer shanks 2*b* and 27*c* is analyzed as follows. The hammer assembly is a cantilever, and the deflection is in proportional to the cube of the length. The distance between the rebounding point and the center of hammer head is further assumed to be 49 millimeters for the prior art hammer assembly 2 and 27 millimeters for the hammer assembly 17. Then, the ratio of the deflection is calculated as follows.

$$(27/49)^3=0.167 \qquad \text{Equation 1}$$

Thus, the rebounding point as close to the center of the hammer head as possible is effective against the undesirable noise due to the touch with the strings.

Moreover, the hammer shanks/heads 17*c* and 17*d* do not exert large moment on the hammer butts 17*a*, and the hammer assemblies 17 are less liable to be broken.

The present inventors compare the load exerted on the hammer assembly of the prior art hammer assembly 2 with the load exerted on the hammer assembly 17. The hammer assemblies 2 and 17 have the moment of inertia IH and the length L from the rotational center of the hammer butts and the rebounding points. The length L is assumed to be 52 millimeters (L1) for the prior art hammer assembly and 74 millemeters (L2) for the hammer asembly 17 according to the present inention. The equivalent mass Mel at the rebounding point is calculated for the prior art hammer assembly 2 as follows.

$$Mel=IH/L1^2 \qquad \text{Equation 2}$$

The equivalent mass MeL at the reounding point is calculated for the haemr assembly 17 according to the present invention as follows.

$$MeL=IH/L2^2 \qquad \text{Equation 3}$$

The ratio between the equivalent masses is given by Equation 3.

$$\begin{aligned} Mel/MeL &= L1^2/L2^2 \qquad \text{Equation 4} \\ &= (L1/L2)^2=(52/74)^2=0.5 \end{aligned}$$

Thus, the load extered on the hammer assembly 17 is decreased to half of that of the prior art, and the hammer shank 17*c* is less broken rather than the hammer shank 2*b*.

Another advantage is derived from the angle of the cushion members 31*c*. Namely, the angle of the cushion members 31*c* is regualted in such a manner that the hammer shanks 17*c* become in parallel to the cushion members 31*c* at the rebound, and undesirable component in the normal direction is not exerted on the hammer stopper 31. As a result, the hamer stopper 31 is durable.

The separation between the cushion members 31*c* adn the rotatable shft 31*a* eliminates noise from the performance through the electronic sounds, because the connecting frame 31*b* absorbs the vibrations due to the imapct against the cushion members 31*c*.

The cushion members 31*f* attached to the rotatable shaft 31*a* receive the damper wires 16*d*, and a damper rail is not required in the keybaord musical instrument according to the present invention.

Finally, in case where the edge of the connecting frame 31*b* is varied depending upon the hammer heads 17*d*, the manufacturer optimize the rebounding points.

Second Embodiment

Figure 9:
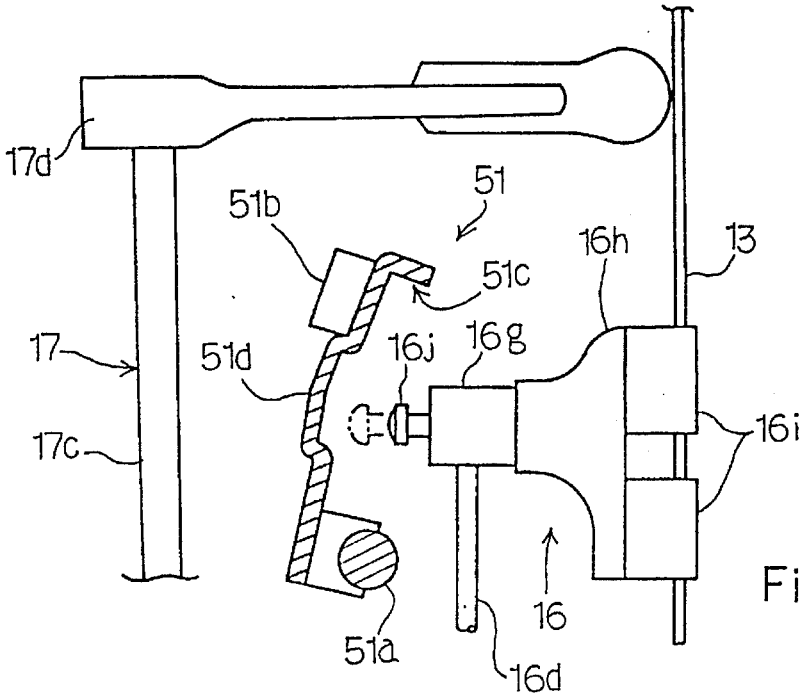
FIG. 9 is a side view showing a hammer stopper and a damper assembly incorporated in another keyboard musical instrument according to the present invention.

Turning to FIG. 9 of the drawings, a hammer stopper 51 is incorporated in another keyboard musical instrument embodying the present invention. The keyboard musical instrument also comprises an acoustic upright piano, an electronic sound system and a silent system, and the hammer stopper 51 forms a part of the keyboard musical instrument. The acoustic upright piano and the electronic sound system are similar to those of the first embodiment, and the description is focused on the hammer stopper 51 only for the sake of simplicity.

The hammer stopper 51 is provided between hammer assemblies 17 and the damper assemblies 16, and includes a rotatable shaft member 51*a*, cushion members 51*b*, a connecting frame 51*c* and a change-over mechanism (not shown) for changing the cushion members 31*c* between a free position and a blocking position. The rotatable shaft 51*a* and the cushion members 51*c* are similar to those of the hammer stopper 31. However, the connecting frame 51*c* is partially embossed. As a result, the middle portion of the connecting frame 51*c* projects from the lower portion and hte upper portion of the connecting frame 51*c*.

While the hammer stopper 51 is staying in the free position, the middle portion 51*d* allows the damper block screw 16*j* to project without an interruption of the hammer stopper 51. For this reason, the hammer stopper 51 does not have the cushion members 31*g*. Even though the cushion members 31*g* are not attached to the rear surface of the connecting frame 51*c*, the damper block screw 16*j* never generates noise, and the performance through the electronic sounds is more comfortable.

Figure 10A:
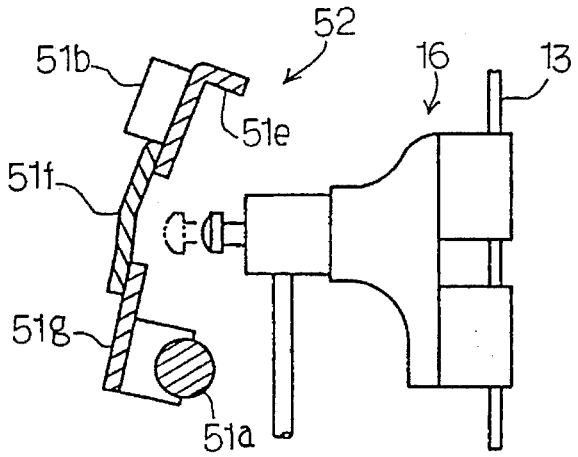
FIGS. 10A and 10B are modifications of the hammer stopper.
Figure 10B:
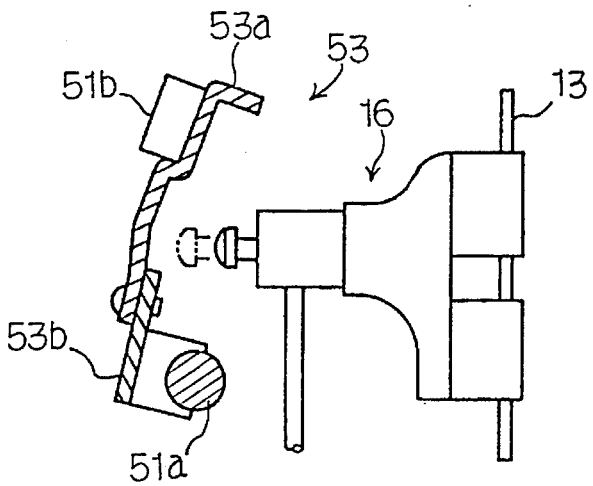

A connecting frame 52 may be formed by bonding or welding upper/middle/lower plate members 51*e* /51*f* /51*g* as shown in FIG. 10A. FIG. 10B shows yet another connectig frame 53 constituted by a partially bent plate member 53*a* and a lower straight plate member 53*b* bolted to the partially bent plate member 53*b*.

The connecting frames 52 and 53 are desirable, because the manufacturer easily optimizes the difference between the middle portion and the upper/lower portions. In the modiication shown in FIG. 10B, the partially bent plate member 53*a* may have an elongated bolt hole so as to adjust the cushion members 51*b* to appropriate positions of the hammer shanks 17*c*.

Third Embodiment

Figure 11:
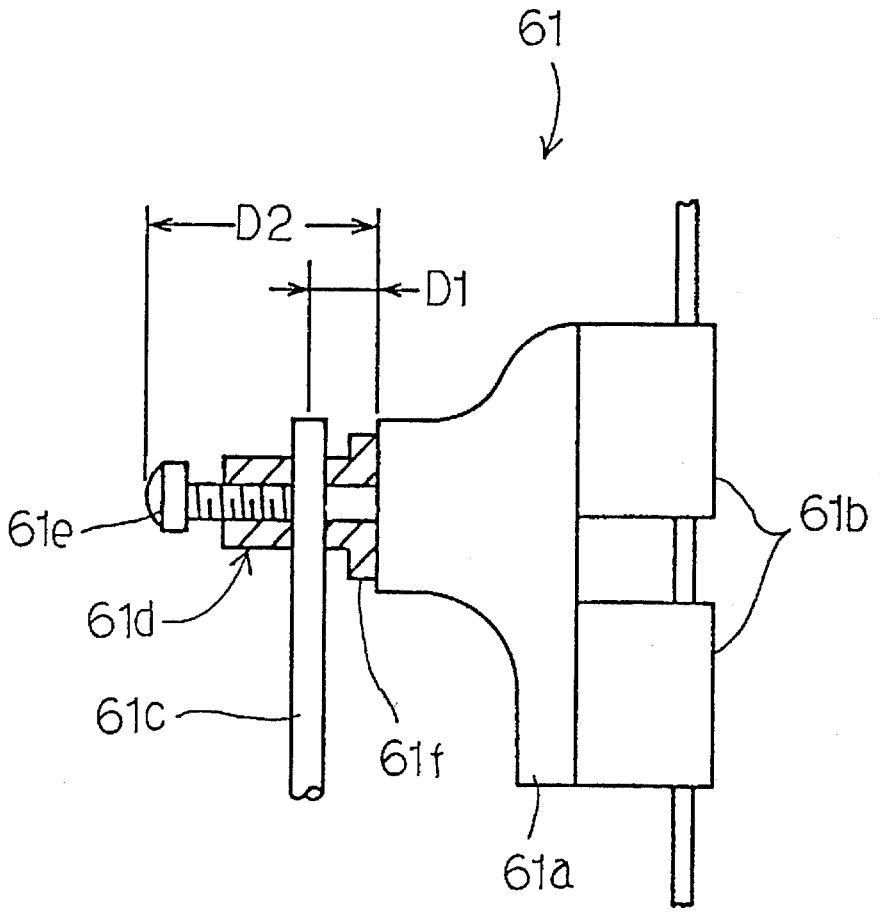
FIG. 11 is a partially cut-away side view showing a damper assembly incorporated in yet another keyboard musical instrument according to the present invention.

Turning to FIG. 11 of the drawings, a damper head 61 is incorproated in yet another keybaord musical instrument embodying the present invention. The keyboard musical instrument implementing the third embodiment also comprises an acoustic upright piano, an electronic sound system and a silent system. However, the electronic sound system and the silent system are similar to those of the first embodiemnt, and the acoustic upright piano is similar to the upright piano 10 except for the damper assemblies 61. For this reaosn, description is made on the damper asembly 61 only.

The damper assembly 61 includes a damper wood 61*a*, damper felts 61*b* attached to the damper wood 61*a*, a damper lever (not shown), a damper wire 61*c* projecting form the damper lever and a damper block 61*d* of metal or plastic resin fixed to the damper wood 61*a* by means of a damper block screw 61*e*. A damper block is formed of wood, and distance D1 is long so as to prevent the damper block from crack. However, the damper block 61*d* of metal or plastic resin is free from the crack, and the didtance D1 is shorter than that of the damper block of wood. For this reason, the distance D2 of the damper block 61*d* is shorter than that of the damper block of wood, and the cushion members 31*g* are eliminated from the hammer stopper incorporated in the keyboard musical instrument implementing the third embodiemnt.

The damper block of metal or plastic resin is so large in mechanical strength that the manufacturer can make the damper block 61*d* small. However, wide contact area with the damper wood 61*a* is required, and, for this reason, a flange 61*f* is formed along the peripehry of the damper block 61*d*.

Although particular embodiments of the present invention have been shown and described, it will be obvious to those skilled in the art that various changes and modifications may be made without departing from the spirit and scope of the present invention.

For example, the keybaord musical instrument according to the present invnetion may be equipped with solenoid-operated actuators provided below the keyboard for an automatic playing, and the controller may record and playback a performance.

The key sensors may be replaced with hammer senseors. The hammer sensors monitor hammer motions for determining hammer motions, and a controller decides depressed keys and impacts on the strings on the basis of the hammer motions.

The silent system may further includes a controlling mechanism for changing gaps between the toes and the regulating buttons. Another controlling mechanism for the regulating buttons may accelerate the jacks so as to quickly escape from the hammer butts in the electronic sound modes.

A plurality of shaft members connected through suitable coupling members may form the rotatable shaft 31*a*.

A hand grip manipulative by a player may be connected to the flexible wire, and an electric motor may be directly connected to the rotatable shaft.

What is claimed is:

1. A keyboard musical instrument allowing a player to perform a music selectively through acoustic sounds and electronic sounds, comprising:

an acoustic piano including a plurality of keys selectively fingered by a player during a performance, a plurality of string means vibrative for generating said acoustic sounds, a plurality of hammer assemblies respectively turning from home positions toward said plurality of string means for producing vibrations in said plurality of strings, a first space being formed between said plurality of string means and said plurality of hammer assemblies at said home positions, a plurality of key action mechanisms respectively transferring forces exerted on said plurality of keys to said plurality of hammer assemblies so as to cause said plurality of hammer assemblies to turn, and a plurality of damper assemblies provided in a part of said first space and temporarily spacing from said plurality of string means so as to allow said plurality of string means to vibrate when said plurality of keys are depressed, a second space being left in said first space;

an electronic sound generating system determining depressed keys of said plurality of keys for generating said electronic sounds corresponding to said acoustic sounds; and a silent system including a hammer stopper having a rotatable shaft extending in a lower sub-space of said second space under a virtual plane over which damper blocks of said plurality of damper assemblies project, and a cushion means supported by said rotatable shaft and moved in an upper sub-space of said second space over said virtual plane between a free position and a blocking position, said cushion means in said free position allowing said plurality of hammer assemblies to strike said plurality of string means, said cushion means in said blocking position causing said plurality of hammer assemblies to rebound thereon without a strike at said plurality of string means.

2. The keyboard musical instrument as set forth in claim 1, in which said damper blocks connect damper wires turnable with respect to said plurality of string means to damper woods holding damper felts, and a lower surface of at least one of said damper blocks is coplanar with said virtual plane.

3. The keyboard musical instrument as set forth in claim 2, in which said plurality of damper mechanisms are rotatably supported by a center rail, and said lower sub-space is higher than said center rail.

4. The keyboard musical instrument as set forth in claim 1, in which said cushion means is provided on a connecting frame fixed to said rotatable shaft.

5. The keyboard musical instrument as set forth in claim 4, in which said connecting frame is formed by a plurality of plate members spaced apart from one another along the rotatable shaft, and cushion members respectively attached to said plate members form in combination said cushion means.

6. The keyboard musical instrument as set forth in claim 5, in which one of said plate members has a curved edge varied in distance from said rotatable shaft.

7. The keyboard musical instrument as set forth in claim 5, in which said plate members have respective leading edges different in distance from said rotatable shaft.

8. The keyboard musical instrument as set forth in claim 4, in which said connecting frame has a middle portion retracted toward said plurality of hammer assemblies rather than a lower portion connected to said rotatable shaft and an upper portion maintaining said cushion means.

9. The keyboard musical instrument as set forth in claim 8, in which said middle portion, said lower portion and said upper portion are welded or bonded to one another.

10. The keyboard musical instrument as set forth in claim 8, in which said middle portion is merged with said upper portion, and is bolted to said lower portion.

11. The keyboard musical instrument as set forth in claim 10, in which a connecting point between said middle portion and said lower portion is adjustable.

12. The keyboard musical instrument as set forth in claim 2, in which said damper blocks are formed of a substance selected from metal and plastic resin.

13. The keyboard musical instrument as set forth in claim 12, in which said damper blocks have respective flanges attached to damper woods holding damper felts.

14. A keyboard musical instrument having an acoustic sound mode for a performance through acoustic sounds and an electronic sound mode for a performance through electronic sounds, comprising:

an acoustic upright piano including a plurality of keys respectively assigned notes of a scale and selectively depressed by a player in both acoustic and electronic sound modes, a plurality of key action mechanisms respectively functionally connected to said plurality of keys and selectively actuated through keys depressed by said player, a plurality of sets of strings respectively assigned said notes of said scale and selectively vibrating for generating said acoustic sounds, a plurality of hammer assemblies selectively driven for free rotations from home positions toward said plurality of sets of strings by key action mechanisms actuated by the depressed keys, a first space being formed between said plurality of sets of strings and said plurality of hammer assemblies at said home positions, and a plurality of damper assemblies provided in said first space and having respective damper wires respectively rotated with respect to said plurality of sets of strings by said plurality of keys, respective damper blocks respectively connected to said damper wires and respective damper felts respectively supported by said damper heads and temporarily leaving the associated sets of strings when said plurality of keys are depressed, a second space being formed between said plurality of hammer assemblies at said home positions and said plurality of damper assemblies held in contact with said plurality of sets of strings;

an electronic sound generating system including a plurality of sensors for determining said depressed keys, and a tone generator for generating said electronic sounds having the notes of said scale corresponding to said depressed keys in said electronic sound mode; and a hammer stopper including a rotatable shaft member extending in a lower sub-space of said second space below lower surfaces of said damper blocks, a plurality of cushion members supported by said rotatable shaft member and positioned in an upper sub-space of said space over said lower surfaces of said damper blocks, said plurality of cushion members being changed between a free position in said acoustic sound mode and a blocking position in said electronic sound mode, said plurality of cushion members in said free position allowing said plurality of hammer assemblies to strike the associated sets of strings, said plurality of cushion members in said blocking position causing the hammer shanks of said plurality of hammer assemblies to rebound thereon before striking said associated sets of strings, a plurality of connecting members connected between said rotatable shaft and said plurality of cushion members, and a change-over unit connected to said rotatable shaft member for changing said plurality of cushion members between said free position and said blocking position.

* * * * *